US005408739A

United States Patent [19]

Altavela et al.

[11] Patent Number: 5,408,739

[45] Date of Patent: Apr. 25, 1995

[54] TWO-STEP DIEING PROCESS TO FORM AN INK JET FACE

[75] Inventors: Robert P. Altavela, Pittsford; Lawrence H. Herko, Palmyra; Almon P. Fisher, Rochester, all of N.Y.

[73] Assignee: Xerox Corporation, Stamford, Conn.

[21] Appl. No.: 55,896

[22] Filed: May 4, 1993

[51] Int. Cl.[6] ..... B26D 1/00; H05B 3/00

[52] U.S. Cl. ..... 29/611; 29/890.1; 83/33; 156/645; 347/47

[58] Field of Search ..... 29/611, 890.1, 412; 156/645; 347/42, 47, 63; 83/33

[56] References Cited

U.S. PATENT DOCUMENTS

Re. 32,572 1/1988 Hawkins et al. .
4,638,337 1/1987 Torpey et al. .
4,774,530 9/1988 Hawkins .
4,878,992 11/1989 Campanelli .
5,057,853 10/1991 Fisher .
5,068,006 11/1991 Fisher .

*Primary Examiner*—P. W. Echols
*Attorney, Agent, or Firm*—Oliff & Berridge

[57] ABSTRACT

A method of dicing a printhead wafer containing a plurality of individual print elements into discreet elements. A back side relief feature is formed on the bottom front edge of a thermal ink jet print element from a heater side during a first dicing cut, followed by a second dicing cut from a channel side of the wafer to form a front face nozzle. The back cut feature enables front face maintenance by a wiper blade or other maintenance operation, provides a pocket for excess die bonding adhesive during manufacture, and reduces front face chipping during dicing caused by the saw blade contacting the die wafer mounting media and becoming contaminated. The relief feature may be a square step feature or a beveled back cut feature and may additionally be located on a top front edge of the print element.

15 Claims, 5 Drawing Sheets

TWO-STEP DIEING PROCESS TO FORM AN INK JET FACE

BACKGROUND OF THE INVENTION

1. Field of the Invention

The invention relates to a two-step dicing operation for forming a front face of an ink jet print element. The first dicing cut dices from the bottom side of the print element and provides a back cut relief feature on the front bottom side of the print element. The second dice cut dices from the top side of the print element to form a finished front nozzle face and completely sever the front of the print element from a wafer.

2. Description of Related Art

Thermal ink jet printing, though capable of continuous stream operation, is generally a type of drop- on-demand ink jet system. In such a system, an ink jet printhead expels ink droplets on demand by selective application of a current pulse to a thermal energy generator, usually a resistor, located in capillary-filled, parallel ink channels a predetermined distance upstream from channel nozzles. The channel end opposite the nozzles are in communication with a small ink reservoir to which a larger external ink supply is connected.

Ink jet printheads are composed of two parts, a channel plate and a heater plate, aligned and bonded together. The heater plate is a substantially flat substrate which contains on the surface thereof a linear array of heating elements and addressing electrodes. The channel plate is a substrate having at least one recess anisotropically etched therein to serve as an ink supply manifold when the two parts are bonded together. A linear array of parallel grooves are also formed in the channel part. One end of the grooves communicates with the manifold recess and the other end is open for use as an ink droplet expelling nozzle. Many printheads are formed by producing a plurality of sets of heating element arrays with their addressing electrodes on a silicon wafer and by placing alignment marks thereon at predetermined locations. A corresponding plurality of sets of channel grooves and associated manifolds are produced in a second silicon wafer. Alignment openings are etched in the second silicon wafer at predetermined locations. The two wafers are aligned via the alignment openings and alignment marks, then bonded together and diced into many separate printheads.

Most known ink jet print elements include a forward step projection on a lower front portion of the element (FIG. 5) or have a straight front face. There are many problems associated with these types of print elements. With the front face step, front face wiping is difficult. Even with a straight face, wiping may not be completely reliable. For example, if a dicing blade does not completely pass through the print element, a burr is left on the front face which can affect wiping blade contact. However, dicing completely through the wafer to eliminate the burr causes its own problems. When the saw blade passes completely through the print element, it comes into contact with print element mounting tape (dicing tape) below the print element wafer, which is usually of a plastic composition having an adhesive on a surface thereof. Cutting through a portion of the dicing tape loads up the dicing blade, causing excessive blade wear, and the blade picks up dicing tape material thereon. This contaminates the dicing blade and the front face of the die.

Chipping or contamination around the nozzle face is undesirable. It leads to ink jet nozzle directionality problems and wiping problems. Replacing the dicing blade frequently to minimize contamination is a costly alternative, especially when a resin blade is used which is expensive and already has a short useful life.

Another problem with both the straight front face and the forward step is that during manufacture, individual print elements are bonded to a heat sink substrate on a PC board. The substrate has a thin layer of a bonding adhesive such as screen-printed silver filled epoxy on top of a portion of the substrate serving as the heat sink. The epoxy is used to bond the individual print element to the substrate. Pressing of the print element onto the epoxy during assembly occasionally causes excess epoxy to extend around the edges of the print element. Any excess die bonding adhesive between the print element and the heat sink that flows onto the front face of the print element interferes with wiping operations and subsequent printing operations of the print element.

Additionally, top and bottom edges of the front face may be sharp or ragged. This can cause excessive wear on a wiping blade which traverses across the printhead, leading to unreliable wiping, inadequate contact, contamination of the front nozzle face and early replacement of the wiper blade.

U.S. Pat. No. 5,057,853, assigned to the same assignee as the present invention, discloses an alternative embodiment which forms a printhead die which has a recessed face. After bonding of heater and channel plate wafers, a first dicing cut is made from the channel side through the channel plate and partially through the heater plate to form a front nozzle face. Subsequently, a second cut is performed from the heater side to provide a recessed step. This has disadvantages. The bottom edge of the already formed front nozzle face may be affected by the back cut, most likely leaving a sharp or ragged edge on the bottom of the front nozzle face where the front face and the back cut adjoin. Further, diced fragments of the material cut during the back cut are expelled toward the front nozzle face from the dicing blade during the back cut and may cause contamination of the previously formed nozzle face surface. Any of these aforementioned disadvantages compromise the quality of the front nozzle face surface. These may cause ink jet directionality problems or may affect performance of a wiping blade which traverses laterally across the entire front face of the printhead, the blade requiring precise contact for best results. Any cracks, large nicks, or sharp edges in the front face surface can affect the reliability of wiper blade cleaning due to uneven or incomplete contact and may result in excessive wear to the wiper blade which can lead to directionality or other ink jet problems.

Alternately in this reference, rather than a straight cut from the heater side, an angled second cut can be made from the channel side to provide a recessed angled surface. However, to accomplish this, the blade itself is angled and the cutting operation is performed through the first cut, i.e., both cuts are from the channel side. Since the width of the first cut is narrow, even if a very thin blade is used there will be highly limited angular adjustment. This reference cannot provide an angled surface of more than about 10 degrees to the vertical. Additionally, due to the small tolerances and the close proximity of adjacent channel plate components, any misplacement of the angled blade may chip or damage the wafer components. Further, due to the necessity of a narrow blade, blade flex may cause a non-uniform or ragged edge surface.

There is a need for a thermal ink jet print element that better enables front face wiping and provides more reliable print head maintenance.

There also is a need for a method of printhead element manufacture which provides a better quality front face surface having less sharp edge surfaces.

OBJECTS AND SUMMARY OF THE INVENTION

It is an object of the invention to provide a print element having a high quality front face nozzle and a recessed back cut relief feature.

It is another object of the invention to prevent contamination of the front face of a print element during bonding of the print element on a heat sink substrate.

It is another object of the invention to provide a print element having increased wiping blade reliability by eliminating sharp edges on the front face.

The above objects and others are achieved and the deficiencies of the known art are overcome by the inventive method of fabricating a thermal ink jet printhead having nozzles for ejecting droplets therefrom comprising the sequential steps of: (a) forming a heater plate comprising a plurality of sets of spaced linear arrays of heating elements and addressing electrodes on the surface of an electrically insulative planar substrate and forming a channel plate by etching a plurality of sets of channel plates comprising parallel channel grooves having closed ends and an associated through recess for each set of channel grooves in the surface of a silicon wafer; (b) aligning and bonding the channel plate to the heater plate to form a composite printhead wafer; (c) performing a first dicing cut that forms a recessed back cut directly below the channel grooves of the channel plate, the first dicing cut being performed from a bottom side of the heater plate and extending only partially through the heater plate; and (d) mounting the composite printhead wafer in a dicing frame and performing a second dicing cut that forms a front nozzle face that defines an end of the channel grooves, the second dicing cut being performed from a top side of the etched wafer and cutting completely through the channel plate and cutting through the heater plate a predetermined distance which overlaps the first dicing cut effectively severing the front side of the wafer.

These and other objects will become apparent from a reading of the following detailed description in connection with the drawings.

BRIEF DESCRIPTION OF THE DRAWINGS

The invention will be described in detail with reference to the following drawings wherein.

DETAILED DESCRIPTION OF PREFERRED EMBODIMENTS

Figure 1:
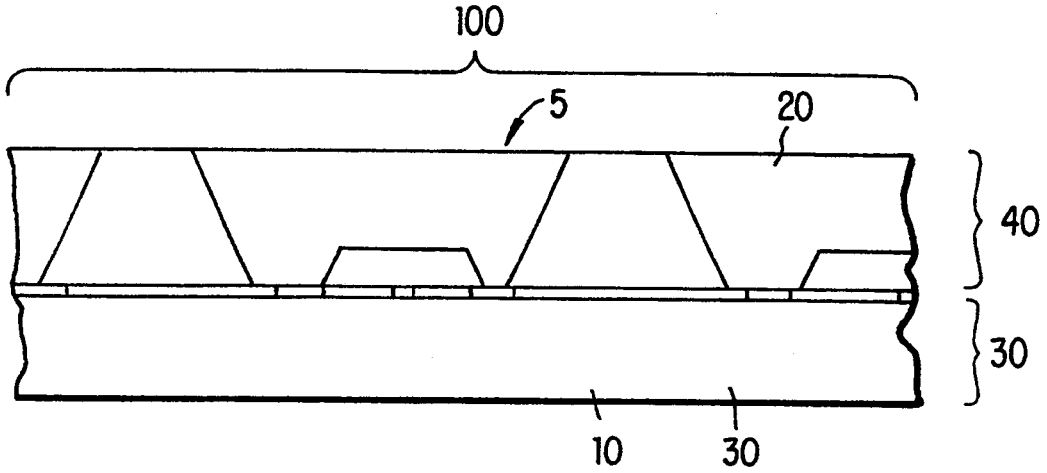
FIG. 1 is a side view of an ink jet print element on a printhead wafer according to an embodiment of the invention prior to dicing.

Ink jet printheads 5 are composed of two parts, a heater plate 10 and a channel plate 20, aligned and bonded together. The heater plate 10 is a substantially flat substrate which contains on the surface thereof a linear array of heating elements and addressing electrodes. The channel plate is a substrate having at least one recess anisotropically etched therein to serve as an ink supply manifold when the two parts are bonded together. A linear array of parallel grooves are also formed in the channel plate 20. One end of the grooves communicates with the manifold recess and the other end of the grooves is open for use as ink droplet expelling nozzles. Many printheads are formed by producing a plurality of sets of heating element arrays with their addressing electrodes on an electrically insulative planar substrate such as a silicon wafer and by placing alignment marks thereon at predetermined locations. A corresponding plurality of sets of channel grooves and associated manifolds are produced in a second silicon wafer. Alignment openings are etched in the second silicon wafer at predetermined locations. The two wafers are aligned via the alignment openings and alignment marks, then bonded together and diced into many separate printheads.

The fabrication of the two wafers 30, 40 to form and bond the channel plates 20 and heater plates 10 into a composite printhead wafer 100 is conventional. An exemplary method of forming the wafers can be found in U.S. Pat. No. Re. 32,572, assigned to the same assignee as the invention, and incorporated herein in its entirety.

Once channel wafer 40 and heater wafer 30 are formed, alignment openings are used with a vacuum chuck mask aligner to align the channel wafer via alignment marks on the heater wafer. The two wafers are accurately mated and tacked together by partial curing of the adhesive. The grooves forming ink nozzles are automatically positioned so that each one has a heating element therein located a predetermined distance from the nozzles or orifices. The two wafers are cured in an oven or a laminator to permanently bond them together.

Figure 8:
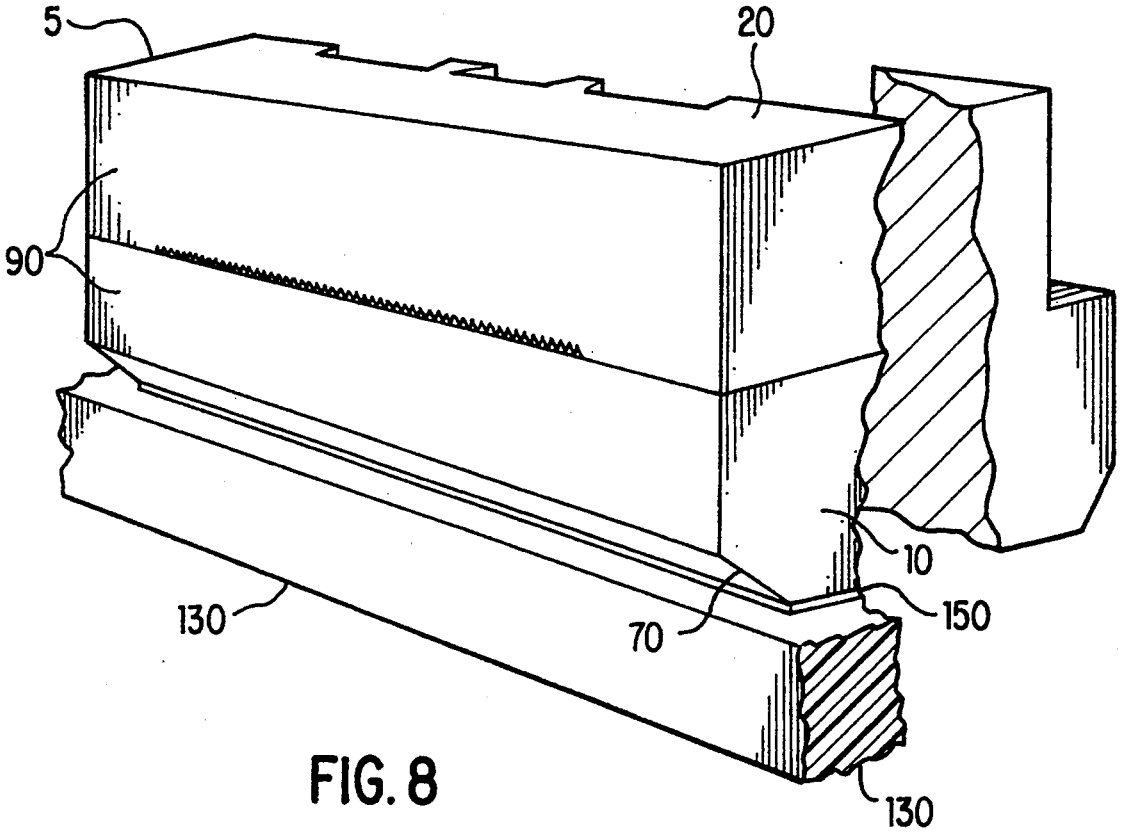
FIG. 8 is an isometric view of a preferred embodiment according to the present invention bonded to a heat sink substrate which is part of a PC board.

The composite wafer 100 as shown in FIG. 1 is then diced to produce a plurality of individual printheads 5 which are bonded to a heat sink substrate 130 that forms part of a daughter board of the ink jet printer (FIG. 8).

Figure 2:
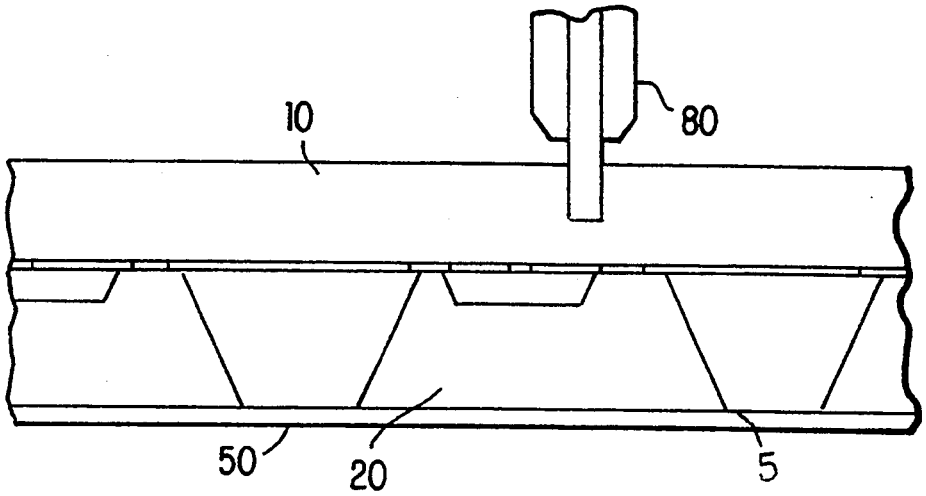
FIG. 2 is a side view of the print element of FIG. 1 during a first dicing cut.

The invention is concerned with the dicing operations of the bonded channel and heater plate wafers which form a front nozzle face and dice the wafer into discreet print elements. Once the bonded composite wafer 100 has cured, dicing tape 50 is first applied to the channel side 20 of the wafer (FIG. 2). The dicing tape 50 can be any of many thin film tapes having adhesive on one side thereof. Preferably, the tape 50 has an adhesive thickness of 5 microns or less. A thickness much greater than 5 microns prevents accuracy in firmly holding the wafer 100 during dicing cuts. A suitable dicing tape is Nitto tape, part number 18074 which has a medium tac and is available from Semiconductor Equipment Corp. in Moorpark, Calif. A more preferred tape is Furakawa UV release tape available from Furakawa Electric Co., Ltd. This tape is preferred for its better release properties, e.g. it does not leave any residue upon release from the wafer surface. This is preferred since in this step the tape covers the important channel side of the wafer.

Reference cuts are made, with wafer 100 mounted on tape 50, to heater side 10 prior to back cutting. The reference cuts are made relative to fiducial alignment markings on the wafer. Preferably, two reference cuts are made at 90° to one another. Only the back cut dicing cuts are precisely aligned relative to the reference cuts.

While the reference cuts provide a simple, low cost method of aligning the subsequent back cut, they are not required. Alternatively, the dicing cuts can be made using an infrared aligner (not shown), without the need for the reference cuts. This reduces manufacturing steps, but requires the infrared aligner. The infrared aligner can be part of the dicing blade and may comprise an IR illuminator and an IR sensor. Once reference cuts have been made, or if an infrared aligner is used, the fabrication process forms the front face of individual print elements and separates the bonded wafer into a plurality of discreet print element dies.

Figure 4:
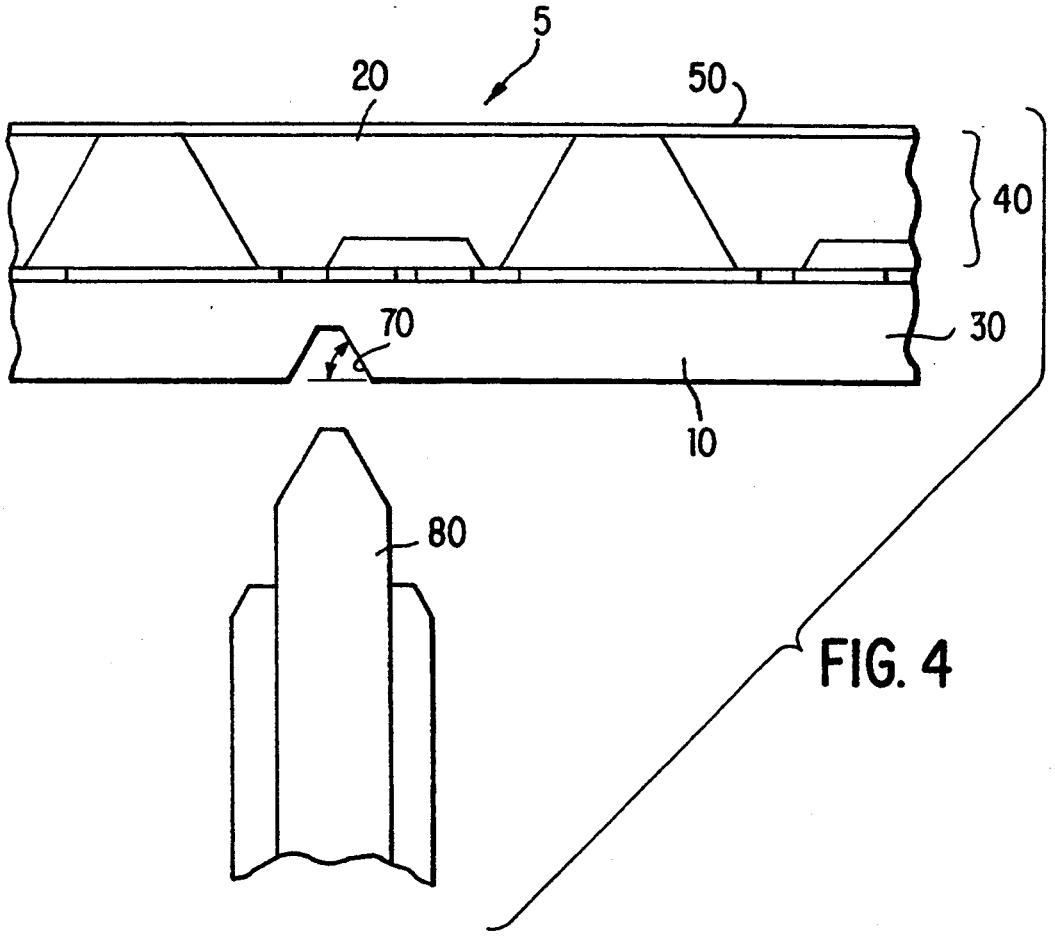
FIG. 4 is a side view of an ink jet print element according to a preferred embodiment of the invention after a first dicing cut.

The composite printhead wafer 100 is unmounted and a first dicing back cut is performed from the heater side 10 of the wafer 100, with the channel side down, to produce a back cut relief feature 60 on what will become part 70 of the front face of individual print elements 5 (FIG. 2). The relief feature is formed using a rotating dicing blade 80. While a standard metal or a resin blade can be used to form the back cut, it has been found that use of a metal blade having 60° chamfered sides (both sides) results in a dicing operation with the least amount of chipping or cracking (FIG. 4). The metal blade is also preferred because of its extremely longer useful life than a resin blade. A metal blade can cut upwards of 1000 wafers, while a typical resin blade can only cut about 10 wafers before it becomes dull or contaminated and starts causing chipping, cracking or burrs. Use of a metal blade with straight edges, i.e., non-chamfered, causes more surface defects than an equivalent resin blade, and both retain sharp edges between the front nozzle face and the back cut, so it would be the least preferred for the first dicing cut.

The first dice cut extends only partially through the heater plate 10 and does not extend into the channel plate 20. The first dice cut is precisely aligned relative to the earlier formed reference cuts or by an infrared aligner and is located directly under channel plate ink channels. This first cut can be performed while the wafer 100 is unmounted (attached solely to tape 50) or can be remounted prior to cutting. The back cut relief feature 60 includes front face portion 70 which is offset from a later formed front nozzle face 90 such that the later formed front nozzle face 90 is a frontmost face of the print element 5. Preferably, the other three sides of the heater plate 10 are also cut to provide a back-cut on all sides.

Since the back cut dicing operation is performed prior to forming of the front nozzle face 90, the quality of the cut is not as crucial as if the back cut were performed after forming of the front face 90. However, providing a good, clean cut minimizes cracks or chips which, if severe enough, could result in a front nozzle face which is not completely planar or defect free.

Figure 3:
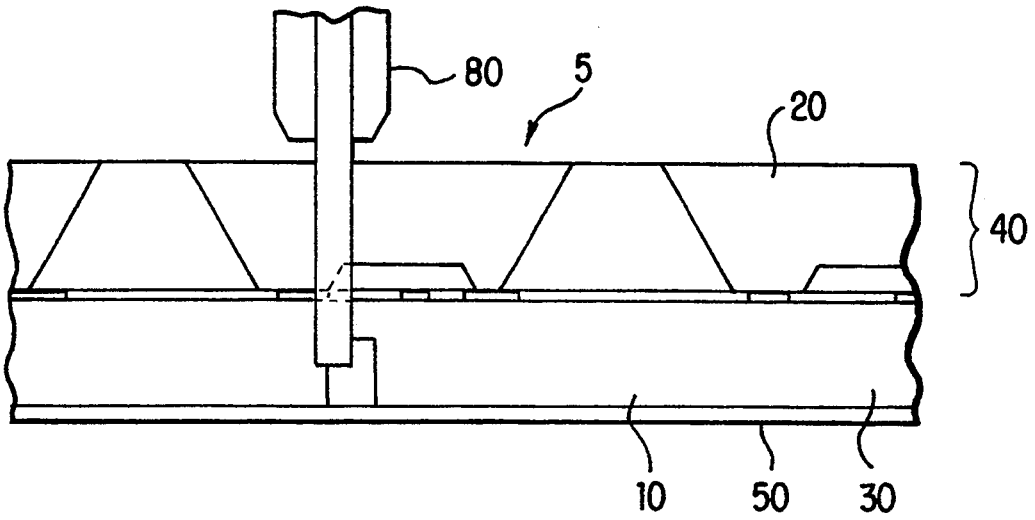
FIG. 3 is a side view of the print element of FIG. 1 during a second dicing cut.

The back cut may consist of a vertical cut as shown in FIGS. 2–3 performed with a blade having straight edges, which provides a back cut relief feature 60 having a face part 70 that is substantially parallel to the later formed front nozzle face 90, but offset towards the wafer a predetermined distance. However, in a preferred embodiment, the back cut is made at an angle to the vertical (FIG. 4). This is done using a blade 80 which is mounted normal to the wafer, but the blade has chamfered edges to provide an angled cut. As previously described, a preferred blade has 60° chamfered edges and provides an angled face portion 70 which is angled about 60° to the horizontal, i.e., from the bottom of the wafer. However, other angles are contemplated, e.g., 30° or 45°, and can work very well. By changing the depth of the cut and the angle, one can provide a predetermined recess distance in from the front face which can accommodate excess bonding epoxy.

With reference to FIG. 3, after the first dicing cut, the printhead wafer 100 is removed from the mount, if mounted. The dicing tape 50 is removed from the channel side 20 and a new layer of release tape 50 is placed on the heater side 10. Since the heater side is less critical and residual adhesive does not adversely affect the print element, a lesser quality, and less-expensive tape such as Nitto tape may be utilized. The printhead wafer 100 is then mounted with the channel side 20 facing up to prepare for a second dicing cut which forms a front nozzle face 90.

Optionally, the top edges (or sides) of the channel plate 20, including a top edge of what will become the front nozzle face, may have back cut features cut thereon similar to those previously described. This would eliminate any sharp edge at the top of the front nozzle face. The optional back cuts may be cut before or after cutting of the front nozzle face 90.

The second dicing cut is performed from the channel side 20 of the wafer 100. The second dicing cut forms the front nozzle face 90 of the print element 5 dicing perpendicularly across the channel grooves to form an end thereof. The second cut cuts completely through the channel plate 20 and only partially through the heater plate 10. The cutting depth through the heater plate 10 is a distance which at least slightly overlaps with the back cut from the first dicing cut to completely sever the front of an individual print element 5 of the wafer 100 and provide a highly planar front nozzle face surface 90.

The second dicing cut should not completely extend through the heater plate 10 since contact with the dicing tape 50 would load up the blade and cause excessive wear and chipping problems. Preferably, the second dicing cut is made with a resin blade. This type of blade is well known in the art of semiconductor dicing and can provide a very high quality front face surface 90 which does not need further processing, such as polishing. The rotational speeds and the feed rate of the dicing blades will vary depending on the specific material being cut and the specific material of the blade used. However, preferred variables and blades are taught in U.S. Pat. No. 4,878,992, assigned to the same assignee as this invention, and incorporated herein in its entirety.

Figure 6:
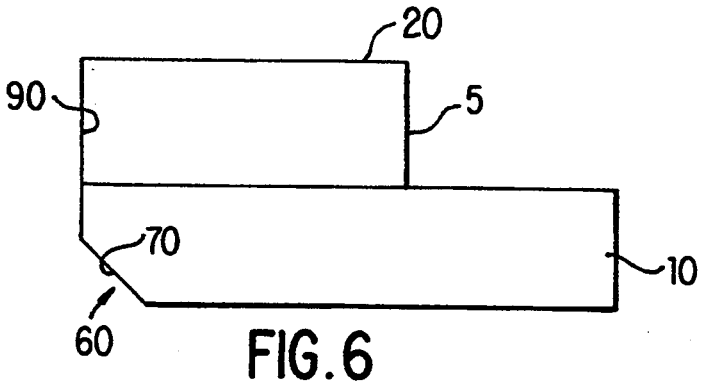
FIG. 6 is a side view of the ink jet print element of FIG. 4 after dicing.
Figure 7:
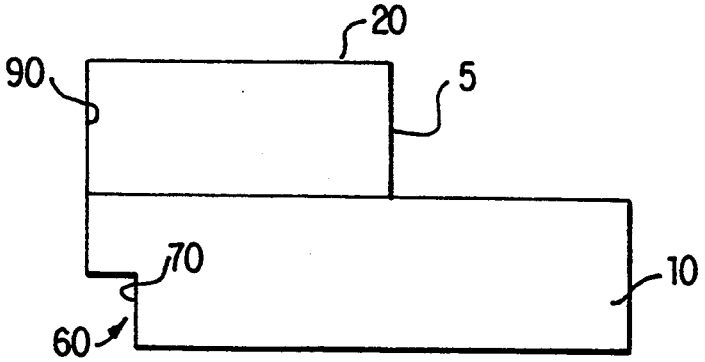
FIG. 7 is a side view of the ink jet print element of FIG. 1 after dicing.

After the complete front face (front face portion 70 and front nozzle face 90) is formed, a section cut is made, perpendicular to the first and second dicing cuts, to separate the wafer 100 into discreet individual print elements 5. Once separated, a final window cut can be made on the back end of the channel plate to expose wire bond pads. See FIGS. 6–7.

Figure 9:
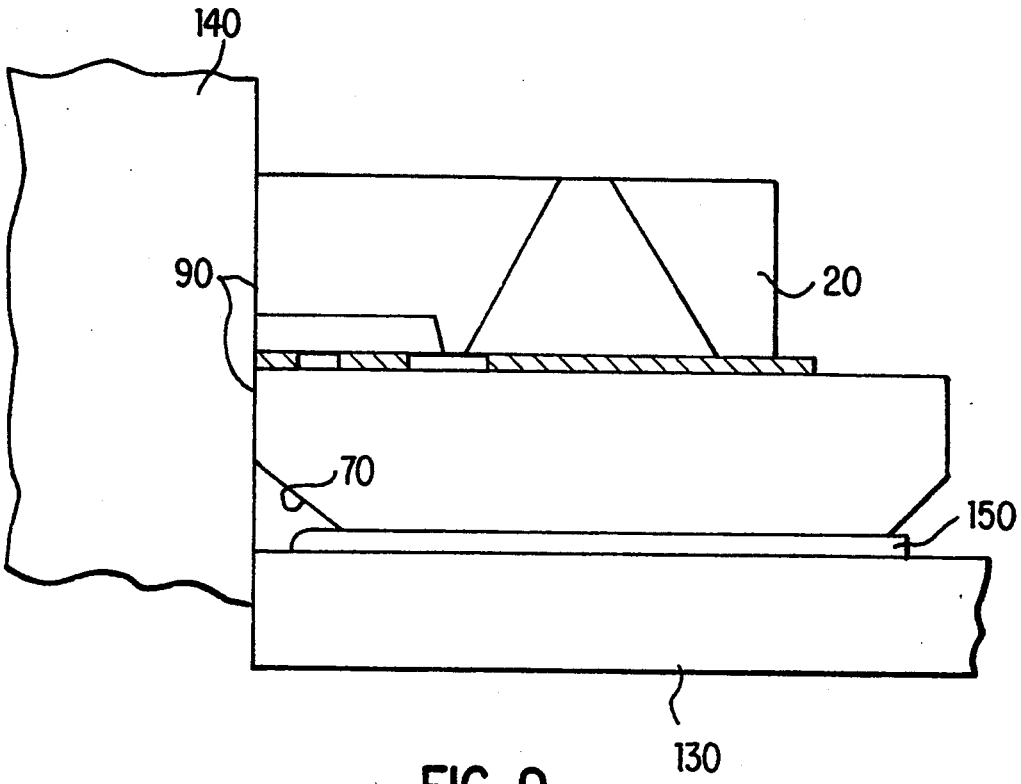
FIG. 9 is a side view of a printhead assembly according to the present invention being wiped by a wiper blade.

Once individual print elements 5 are separated, they are fixedly mounted on a heat sink substrate 130 of a printer daughterboard (FIGS. 8–9). To accomplish this, a thin layer, preferably 0.75–1 mil thick, of a bonding adhesive such as screen-printed silver-filled epoxy 150 is placed on top of a receiving portion of substrate 130. The epoxy layer is sized to have dimensions approximately the same as the bottom of element 5 to provide solid mounting. The print element is then firmly placed on the epoxy and bonded. Any excess adhesive slightly flows around edges of element 5. However, due to the back cut relief feature 60, any excess will not flow past front nozzle face 90. This prevents any excess epoxy from extending beyond front face 90, allowing for more reliable wiping as shown in FIG. 9. The exact size of feature 60 will vary depending on the thickness and flow characteristics of the bonding agent used to accommodate the excess.

Figure 5:
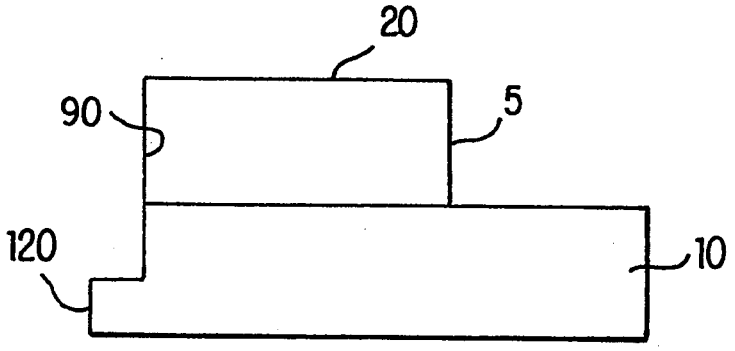
FIG. 5 PRIOR ART
FIG. 5 is a side view of a known thermal ink jet print element.

There are many advantages associated with the above method. By having a front nozzle face which does not include a stepped portion 120 (such as in FIG. 5) which extends forward of the nozzle face 90, a wiping operation is able to be performed directly on the front nozzle face 90 itself (FIG. 9). Also, of primary importance is the high quality of the front face surface which results from the above method which eliminates sharp edges and provides a feature for containing excess bonding adhesive. Of equal importance is the reduced fabrication steps and manufacturing costs necessary when utilizing the present method to dice a wafer containing a plurality of print elements into discreet individual printhead die.

The methods according to the invention overcome the disadvantages with the prior art and result in a more precise and well-defined front nozzle face which has good ink jet directionality and a planar front face surface which can easily and reliably be cleaned by a movable wiping blade 140 (FIG. 9).

The invention has been described with reference to the preferred embodiments thereof, which are illustrative and not limiting. Various changes may be made without departing from the spirit and scope of the invention as defined in the appended claims.

What is claimed is:

1. A method of fabricating a thermal ink jet printhead having nozzles for ejecting droplets therefrom comprising the sequential steps of:

(a) forming a heater plate comprising a plurality of sets of spaced linear arrays of heating elements and addressing electrodes on the surface of an electrically insulative planar substrate and forming a channel plate by etching a plurality of sets of channel plates comprising parallel channel grooves having closed ends and an associated through recess for each set of channel grooves in the surface of a silicon wafer;

(b) aligning and bonding the channel plate to the heater plate to form a composite printhead wafer;

(c) performing a first dicing cut that forms a recessed back cut directly below the channel grooves of the channel plate, the first dicing cut being performed from a bottom side of the heater plate and extending only partially through the heater plate; and (d) mounting the composite printhead wafer in a dicing frame and performing a second dicing cut that forms a front nozzle face that defines an end of the channel grooves, the second dicing cut being performed from a top side of the etched wafer and cutting completely through the channel plate and cutting through the heater plate a predetermined distance that overlaps the first dicing cut to effectively sever the front side of the wafer, the front nozzle face extending outward beyond the back cut.

2. The method of claim 1, wherein prior to step (c), a reference cut is made completely through the heater plate, the reference cut being cut a predetermined distance from a known alignment mark on the composite printhead wafer.

3. The method of claim 2, wherein the reference cut consists of two cuts cut 90° from one another.

4. The method of claim 2, wherein the first dicing cut is aligned using the reference cut.

5. The method of claim 1, wherein the first dicing cut and the second dicing cut are aligned using an infrared aligner.

6. The method of claim 1, wherein the first cut is made using a blade having chamfered edges, the chamfered edges cutting an angled back cut relief feature having an angled face portion.

7. The method of claim 6, wherein the blade is positioned normal to the wafer to provide the angled relief feature when performing the first dice cut.

8. The method of claim 7, wherein the first dice cut is performed using a metal blade.

9. The method of claim 7, wherein the first dice cut is performed using a dicing blade having about 30°–60° chamfered edges.

10. The method of claim 1, wherein dicing tape is placed on a channel side of the printhead wafer prior to the first dicing cut.

11. The method of claim 10, wherein the dicing tape is removed prior to the second dice cut.

12. The method of claim 1, wherein dicing tape is placed on a heater side of the printhead wafer prior to the second dice cut.

13. The method of claim 12, wherein the dicing tape is removed after performing the second dice cut.

14. The method of claim 1, further including a step of performing a recessed back cut on the channel side adjacent the front nozzle face.

15. The method of claim 1, wherein step (c) forms a front side of the heater plate and three additional back cuts are performed to form sides and a back of the heater plate.

* * * * *